US006018134A

United States Patent [19]

Hirano et al.

[11] Patent Number: 6,018,134

[45] Date of Patent: Jan. 25, 2000

[54] MAIN CIRCUIT SWITCHING APPARATUS

[75] Inventors: Yoshiki Hirano; Naoyuki Nakatsukasa; Daisuke Yoshida; Kouichirou Wada; Mikio Mori; Masashi Matsuki, all of Tokyo, Japan

[73] Assignee: Mitsubishi Denki Kabushiki Kaisha, Tokyo, Japan

[21] Appl. No.: 09/021,381

[22] Filed: Feb. 10, 1998

[30] Foreign Application Priority Data

Aug. 8, 1997 [JP] Japan ..... 9-214806

[51] Int. Cl.[7] ..... H01H 33/70

[52] U.S. Cl. ..... 218/70; 218/84; 218/115; 218/120; 218/154

[58] Field of Search ..... 218/30, 37, 38, 218/78–80, 84, 92, 115, 118, 120, 123, 140, 154

[56] References Cited

U.S. PATENT DOCUMENTS

| | | | |
|---|---|---|---|
| 3,784,771 | 1/1974 | Olsen | 218/154 |
| 3,787,649 | 1/1974 | Goodwin, Jr. et al. | 335/131 |
| 3,935,407 | 1/1976 | Bleibtreu et al. | 33/42 |
| 4,086,645 | 4/1978 | Gorman et al. | 361/155 |
| 5,424,504 | 6/1995 | Tanaka et al. | 218/78 |

FOREIGN PATENT DOCUMENTS 8-306282 11/1996 Japan .

*Primary Examiner*—Lincoln Donovan
*Attorney, Agent, or Firm*—Sughrue, Mion, Zinn, Macpeak & Seas, PLLC

[57] ABSTRACT

A main circuit portions are arranged in the order of a breaking section fixed-side conductor, a breaking section movable-side conductor, a disconnecting section movable-side conductor, and a disconnecting section fixed-side conductor, and first and second grounding conductors are respectively provided for grounding the breaking section fixed-side conductor and the disconnecting section fixed-side conductor at both end portions of the apparatus. The arrangement of operating devices is set in the order of a first grounding-section operating device, a breaking-section operating device, a disconnecting-section operating device, and a second grounding-section operating device. In addition, a breaking section is supported by a single supporting insulator to reduce the number of creepage insulation portions.

7 Claims, 5 Drawing Sheets

MAIN CIRCUIT SWITCHING APPARATUS

BACKGROUND OF THE INVENTION

1. Field of the Invention

The present invention relates to a main circuit switching apparatus disposed between a generator and a main transformer in a power plant.

2. Description of the Related Art

FIG. 4 is a single-line diagram of a power plant, and shows one which is generally adopted conventionally. In the drawing, G denotes a generator; M.Tr denotes a main transformer; H.Tr denotes an in-house transformer; S.Tr denotes a starting transformer; S1–S4 denote circuit breakers; B denotes a bus; and L1 and L2 denote transmission lines. The generator G and the main transformer M.Tr are directly connected to each other, and when the generator G is started, electric power for starting the generator G is supplied to the bus B via the starting transformer S.Tr, and the generator G is connected to the transmission line L1 via the main transformer M.Tr by means of the breaker S1 in synchronism with the voltage of the transmission line L1.

Recently, a low-tension synchronization system such as the one shown in a single-line diagram in FIG. 5 has come to be adopted instead of the above-described high-tension synchronization system.

In this case, a main circuit switching apparatus A is installed for the generator G. FIG. 6 shows the details of the main circuit switching apparatus A. In the drawing, B denotes a main circuit breaker; C denotes a main circuit disconnecting switch; D denotes a breaker-side grounding device; and E denotes a disconnecting switch-side grounding device. Here, if all of the main circuit breaker B, the main circuit disconnecting switch C, and the breaker-side and disconnecting switch-side grounding devices D and E are arranged by being integrated as a unit rather than being collected together as individual single devices, the total installation area can be made small, and the production cost can be lowered, so that the main circuit switching apparatus of this integrated type is tending to be adopted on an increasing scale.

FIG. 7 is a cross-sectional view of a main circuit switching apparatus of the integrated type which is disclosed in, for example, Japanese Patent Application Laid-Open No. 8-306282. In the drawing, reference numeral 1 denotes a breaking section; 2, an insulating barrel; 3, a breaking section fixed-side conductor fixed to one end of the insulating barrel 2; 4, a breaking section movable-side conductor attached to the other end of the insulating barrel 2; 5, a fixed contact fixed to the breaking section fixed-side conductor 3; and 6, a movable contact attached to the breaking section movable-side conductor 4 in such a manner as to be capable of coming into contact with and moving away from the fixed contact 5. The insulating barrel 2, the breaking section fixed-side conductor 3, the breaking section movable-side conductor 4, the fixed contact 5, and the movable contact 6 constitute the breaking section 1.

Numeral 8 denotes a disconnecting section; 9, a disconnecting section fixed-side conductor formed integrally with the breaking section movable-side conductor 4, a partition wall 10 being provided between the disconnecting section fixed-side conductor 9 and the breaking section movable-side conductor 4, and an insulating gas such as sulfur hexafluoride being sealed in on the breaking section 1 side. Numeral 11 denotes a disconnecting section movable-side conductor disposed by being spaced apart from the disconnecting section fixed-side conductor 9; and 12 denotes a movable conductor attached to the disconnecting section movable-side conductor 11 in such a manner as to be capable of coming into contact with and moving away from the disconnecting section fixed-side conductor 9. The disconnecting section fixed-side conductor 9, the disconnecting section movable-side conductor 11, and the movable conductor 12 constitute the disconnecting section 8.

Numeral 14 denotes a first grounding conductor for grounding the breaking section fixed-side conductor 3; and 15 denotes a second grounding conductor for grounding the disconnecting section movable-side conductor 11.

Numeral 16 denotes a supporting rack; 17 and 18 denote first and second supporting insulators for supporting on the supporting rack 16 an integrated portion formed by the breaking section 1 and the disconnecting section fixed-side conductor 9; and 19 denotes a third supporting insulator for supporting on the supporting rack 16 the disconnecting section movable-side conductor 11 and the movable conductor 12.

Numeral 21 denotes a breaking-section operating device which has a first insulated operating rod 22 to operate the movable contact 6 of the breaking section 1. Numeral 23 denotes a disconnecting-section operating device which has a second insulated operating rod 23 to operate the movable conductor 12 of the disconnecting section 8. Numerals 25 and 26 denote first and second grounding-section operating devices for operating the first and second grounding conductors 14 and 15.

On the supporting rack 16, the breaking section 1 and the disconnecting section 8 are arranged in the order of the breaking section fixed-side conductor 3, the breaking section movable-side conductor 4, the disconnecting section fixed-side conductor 9, and the disconnecting section movable-side conductor 11. The respective operating devices are accommodated and fixed in the supporting rack 16 in the order of the first grounding-section operating device 25, the breaking-section operating device 21, the disconnecting-section operating device 23, and the second grounding-section operating device 26.

In the above-described manner, the main circuit switching apparatus A is formed in which the respective devices B, C, D, and E shown in FIG. 6 are integrated as a unit.

The conventional main circuit switching apparatus of the integrated type configured as described above is advantageous in terms of the reduction of the installation area and the lowering of production cost as compared with the case where the breakers, disconnecting switches, and grounding devices are respectively formed as single devices. However, the conventional main circuit switching apparatus of the integrated type has the following problems.

(i) In order for the respective operating devices to operate properly, it must be ensured that the operating devices, the grounding conductors, and the supporting insulators do not interfere with each other. To avoid the interference, it is necessary to elongate the axial length L of the main circuit switching section and dispose the grounding devices on opposite end sides thereof, with the result that the integration of the grounding devices leads to the large size of the apparatus. Meanwhile, it is also conceivable to dispose the grounding-section operating devices in a space which is produced between the breaking-section operating device and the disconnecting-switch operating device so as not to elongate the length L. However, the arrangement of the operating devices at that time does not conform to the same order as that of the electrical arrangement of the main circuit switching apparatus such as the one shown in FIG. 6 in which the grounding devices are disposed at opposite ends of the main circuit breaking section and the main circuit disconnecting section which are connected in series. Since there is a possibility of causing erroneous confirmation and erroneous operation, such an arrangement is not preferable.

(ii) Since the main circuit switching apparatus is mechanically divided into two portions, i.e., one portion in which the breaking section and the disconnecting section fixed-side conductor are integrated and another portion including the disconnecting section movable-side conductor and the movable conductor, it is necessary to respectively insulate and support these two portions independently. As for the former portion between them, since the weight of the disconnecting section fixed-side conductor is much lighter than the weight of the breaking section, the position of its center of gravity is substantially not different from the position of the center of gravity of the breaking section alone, and is located on the insulating barrel of the breaking section, so that it is difficult to provide insulation and support at one location in the vicinity of the position of the center of gravity. For this reason, insulation and support are provided at two locations on the breaking section movable-side conductor and the breaking section fixed-side conductor. This means that two creepage insulation portions are present for the breaking section and the disconnecting section fixed-side conductor with respect to the ground, which leads to the lowering of electrical reliability, and increases the number of component parts, resulting in higher cost.

(iii) Since the disconnecting section fixed-side conductor which comes into contact with and moves away from the movable conductor is provided on the disconnecting section side, it is difficult to effect inspection from the outside on the state of contact in a state in which the disconnecting switch is on.

If cases where the low-tension synchronization system is adopted increase as in the recent years, there have been increasing demands for reducing the installation space required for installing the main circuit switching apparatus, lowering the producing cost, and providing the main circuit switching apparatus which is highly reliable, facilitates maintenance and inspection, and has good operational efficiency. In particular, in underground power plants where the installation space is limited, or in the case of independent power producer (IPP) where the operation is undertaken by users for whom electrical knowledge is not required as a special field, these demands have been increasingly strong.

SUMMARY OF THE INVENTION

The present invention has been devised in view of the above-described circumstances, and provides a main circuit switching apparatus having small dimensions and also provides a main circuit switching apparatus which is highly reliable, easy to use, and inexpensive.

Therefore, according to the present invention, there is provided a main circuit switching apparatus comprising: a breaking section having a breaking section fixed-side conductor provided with a fixed contact, and a breaking section movable-side conductor provided with a movable contact being contactable with the fixed contact; a disconnecting section having a disconnecting section fixed-side conductor and a disconnecting section movable-side conductor which are disposed by being spaced apart from each other, the disconnecting section movable-side conductor having a movable conductor being contactable with the disconnecting section fixed-side conductor; at least one of supporting insulators supporting the breaking section and disconnecting section on a supporting rack; a breaking-section operating device for operating the movable contact; a disconnecting-section operating device for operating the movable conductor; a first grounding-section operating device operating a first grounding conductor for grounding the breaking section fixed-side conductor; and a second grounding-section operating device operating a second grounding conductor for grounding the disconnecting section fixed-side conductor, wherein the breaking section fixed-side conductor, the breaking section movable-side conductor, the disconnecting section movable-side conductor, and the disconnecting section fixed-side conductor are arranged in this order in a horizontal direction, and the breaking section movable-side conductor and the disconnecting section movable-side conductor are electrically and mechanically integrated as a unit, and further wherein the first grounding-section operating device, the breaking-section operating device, the disconnecting-section operating device, and the second grounding-section operating device are attached to the supporting rack in this order in the horizontal direction.

Further, in the main circuit switching apparatus in accordance with the present invention, the breaking section, the disconnecting section movable-side conductor, and the movable conductor are supported by one supporting insulator.

DETAILED DESCRIPTION OF THE PREFERRED EMBODIMENTS

First Embodiment

Figure 1:
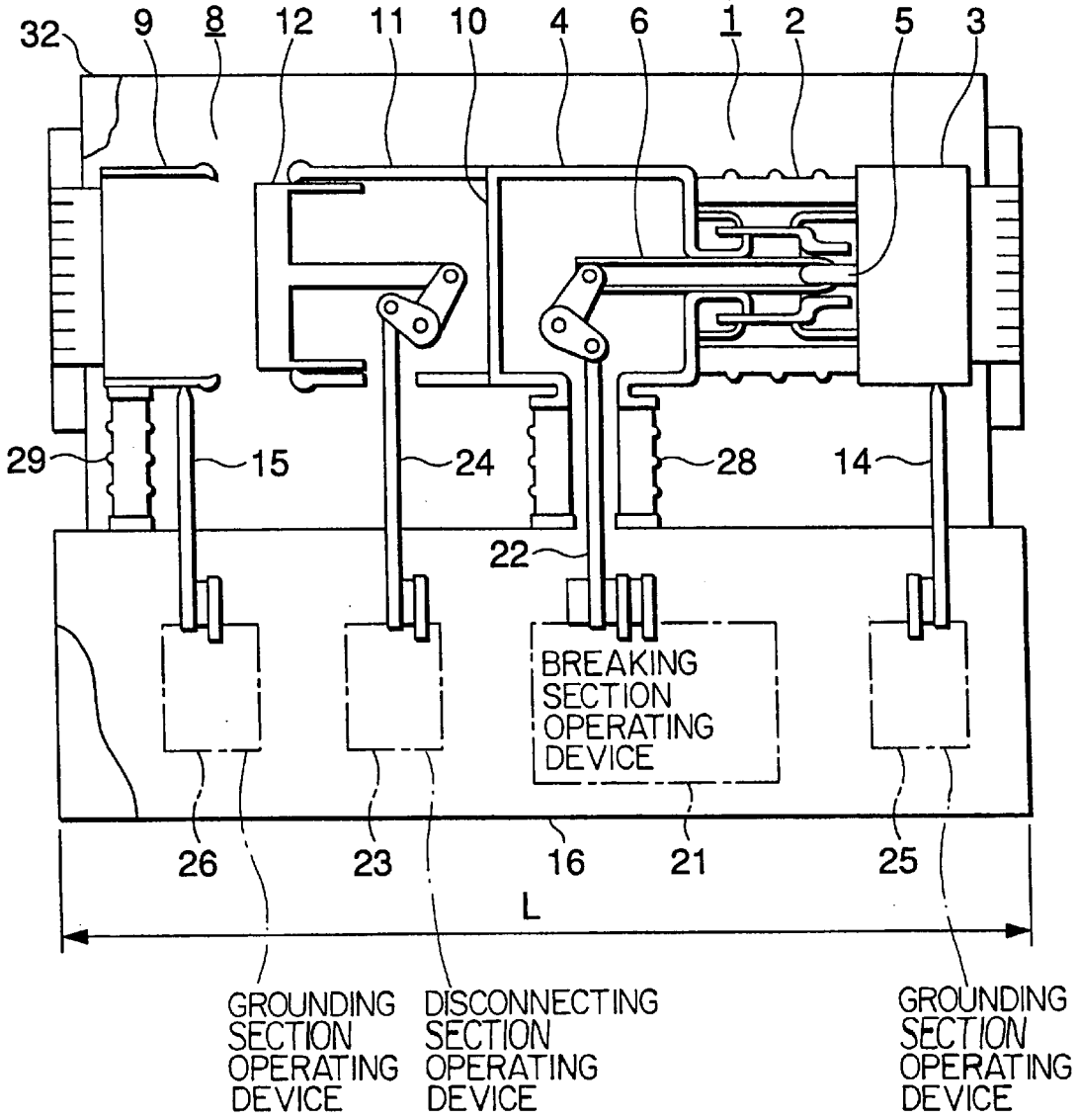
FIG. 1 is a cross-sectional view of a main circuit switching apparatus illustrating a first embodiment of the present invention.

FIG. 1 is a cross-sectional view of a main circuit switching apparatus illustrating a first embodiment of the present invention. In the drawing, reference numeral 1 denotes a breaking section for breaking a current; 2, an insulating barrel formed of an epoxy resin or the like; 3, a breaking section fixed-side conductor having the shape of a cylindrical container and fixed to one end of the insulating barrel 2; 4, a breaking section movable-side conductor having the shape of a cylindrical container and fixed to the other end of the insulating barrel 2; 5, a fixed contact fixed to the breaking section fixed-side conductor 3; and 6, a movable contact attached to the breaking section movable-side conductor 4 in such a manner as to be movable in the left-and-right directions in the drawing, and adapted to come into contact with and move away from the fixed contact 5. The insulating barrel 2, the breaking section fixed-side conductor 3, the breaking section movable-side conductor 4, the fixed contact 5, and the movable contact 6 constitute the breaking section 1.

Numeral 8 denotes a disconnecting section for cutting off a voltage, and numeral 11 denotes a disconnecting section movable-side conductor having a hollow cylindrical shape and formed electrically and mechanically integrally with the breaking section movable-side conductor 4, a partition wall 10 being provided between the disconnecting section movable-side conductor 11 and the breaking section movable-side conductor 4, and an insulating gas such as sulfur hexafluoride being sealed in on the breaking section 1 side. Numeral 12 denotes a movable conductor having a hollow cylindrical shape and fixed to the disconnecting section movable-side conductor 11 in such a manner as to be movable in the left-and-right directions in the drawing. Numeral 9 denotes a disconnecting section fixed-side conductor having a hollow cylindrical shape and disposed by being spaced apart from the disconnecting section movable-side conductor 11. The arrangement provided is such that the movable conductor 12, whose outer periphery slides on the inner periphery of the disconnecting section movable-side conductor 11, comes into contact with and moves away from the inner periphery of the disconnecting section fixed-side conductor 9 at its outer periphery. The disconnecting section fixed-side conductor 9, the disconnecting section movable-side conductor 11, and the movable conductor 12 constitute the disconnecting section 8.

Numeral 14 denotes a first grounding conductor which is at ground-level potential. During the operation of the power plant, the first grounding conductor 14 is lowered in a downward direction as viewed in the drawing, while, during inspection or the like, the first grounding conductor 14 is raised to allow its distal end to come into contact with the breaking section fixed-side conductor 3 so as to be grounded, thereby ensuring safety. Numeral 15 denotes a second grounding conductor which is at the ground-level potential for grounding the disconnecting section fixed-side conductor 9.

Since the second grounding conductor 15 is arranged to ground not the disconnecting section movable-side conductor 11, but the disconnecting section fixed-side conductor 9 disposed on an end portion side of the apparatus, the second grounding conductor 15 is naturally disposed on the end portion side of the apparatus in the same way as in the conventional art.

Numeral 16 denotes a supporting rack; 28 denotes a first supporting insulator having a hollow shape for supporting on the supporting rack 16 an integrated portion formed by the breaking section 1, the disconnecting section movable-side conductor 11, and the movable conductor 12; and numeral 29 denotes a second supporting insulator for supporting on the supporting rack 16 the disconnecting section fixed-side conductor 9.

Numeral 21 denotes a breaking-section operating device for operating the breaking section 1, and the breaking-section operating device 21 has a first insulated operating rod 22 which is passed through a hollow portion of the first supporting insulator 28 and is connected to a lever 30 inside the breaking section movable-side conductor 4. As the first insulated operating rod 22 is moved vertically, the movable contact 6 is driven to operate the breaking section 1. Numeral 23 denotes a disconnecting-section operating device for operating the disconnecting section 8, and the disconnecting-section operating device 23 has a second insulated operating rod 24 connected to a lever 31 inside the disconnecting section movable-side conductor 11. As the second insulated operating rod 24 is moved vertically, the movable conductor 12 is driven to operate the disconnecting section 8. Numerals 25 and 26 denote first and second grounding-section operating devices for operating the first and second grounding conductors by driving them vertically.

On the supporting rack 16, the breaking section 1 and the disconnecting section 8 are arranged horizontally in the order of the breaking section fixed-side conductor 3, the breaking section movable-side conductor 4, the disconnecting section movable-side conductor 11, and the disconnecting section fixed-side conductor 9. These conductors as a whole are covered with an outer covering 32.

In addition, the respective operating devices are accommodated and fitted in the supporting rack 16 horizontally in the order of the first grounding-section operating device 25, the breaking-section operating device 21, the disconnecting-section operating device 23, and the second grounding-section operating device 26.

Figure 6:
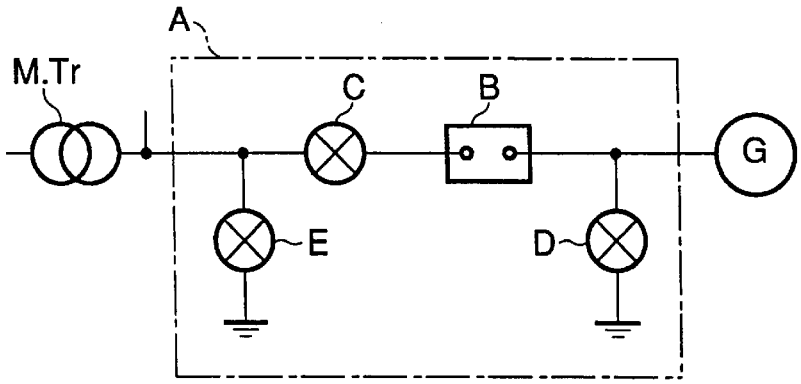
FIG. 6 is a single-line diagram of a main circuit switching apparatus.

The breaking section 1 and the breaking-section operating device 21 constitute the main circuit breaking section B shown in FIG. 6. At the same time, the disconnecting section 8 and the disconnecting-section operating device 23 constitute the main circuit disconnecting switch C, the first grounding conductor 14 and the first grounding-section operating device 25 constitute the disconnecting switch-side grounding device D, and the second grounding conductor 15 and the second grounding-section operating device 26 constitute the disconnecting switch-side grounding device E. Thus, the main circuit switching apparatus A is formed in which these devices are integrated as a unit.

As described above, in the disconnecting section 8, the disconnecting section movable-side conductor 11 is disposed on the breaking section 1 side, and the disconnecting section fixed-side conductor 9 is disposed on the side opposite to the breaking section 1, i.e., on the left-end side in FIG. 1, and is grounded by the second grounding conductor 15. Accordingly, the space below the disconnecting section movable-side conductor 11 and the space below the disconnecting section fixed-side conductor 9 can be easily used as the space for installing the disconnecting-section operating device 23 and the space for installing the second grounding-section operating device 26. Therefore, it is possible to obtain an appropriate arrangement of the operating devices in which the operating devices, the grounding conductors, and the supporting insulators do not interfere with each other without elongating the axial length L of the main circuit switching section.

In addition, the arrangement of the operating devices is in the order of the first grounding-section operating device 25, the breaking-section operating device 21, the disconnecting-section operating device 23, and the second grounding-section operating device 26, which is the same order as that of the electrical arrangement of the main circuit switching apparatus shown in FIG. 6. As a result, the state of the main circuit switching apparatus can be ascertained at a glance on the basis of the display of the switching state of each operating device, thereby reducing the possibility of erroneous confirmation and erroneous operation.

Furthermore, since the disconnecting section fixed-side conductor 9 is disposed at an end portion of the main circuit switching apparatus, the state of contact between the disconnecting section fixed-side conductor 9 and the movable conductor 12 can be confirmed through a manhole (not shown) at the end portion, so that the adjustment and inspection of contact portions can be facilitated.

Furthermore, in this embodiment, the breaking section 1, the disconnecting section movable-side conductor 11, and the movable conductor 12 are supported by one first supporting insulator 28.

Figure 7:
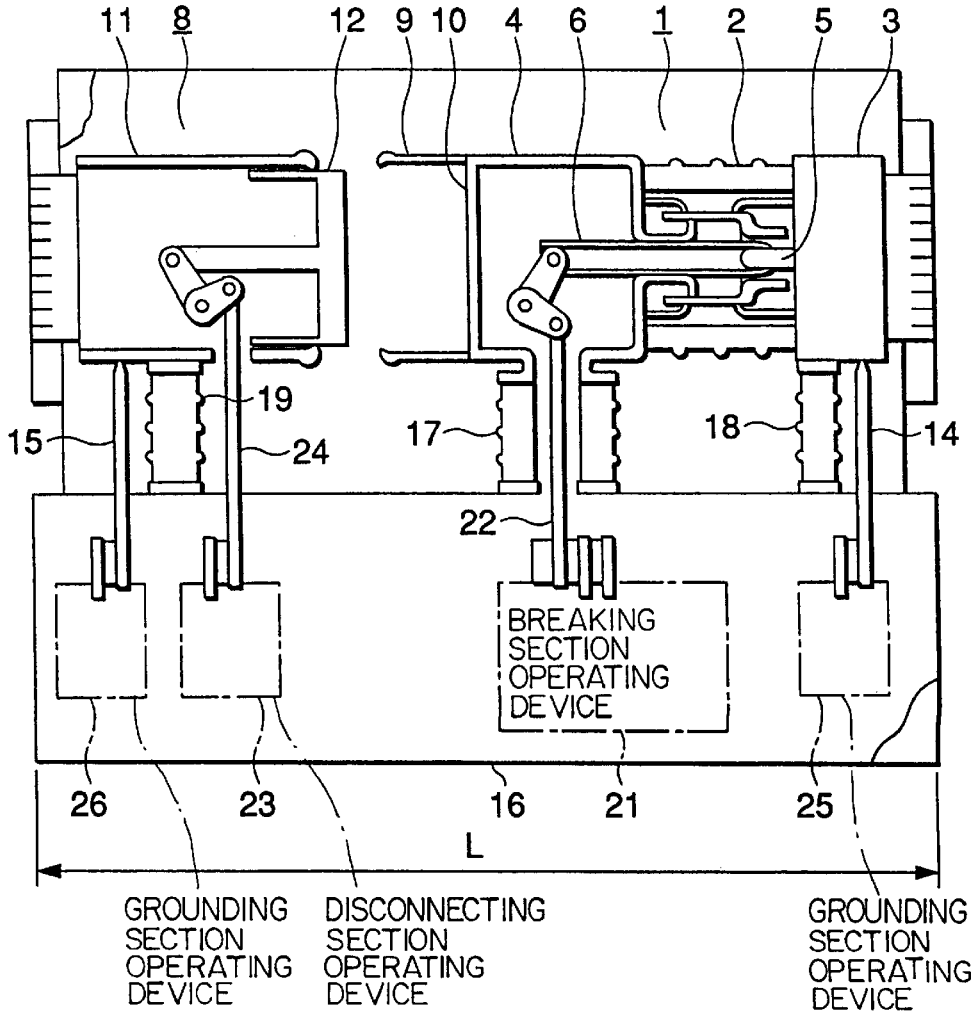
FIG. 7 is a cross-sectional view of a conventional main circuit switching apparatus.

Since the disconnecting section fixed-side conductor 9 and the disconnecting section movable-side conductor 11 are air-insulated, the disconnecting section fixed-side conductor 9 and the disconnecting section movable-side conductor 11 must be supported by different insulators. On the breaking section 1 side where the disconnecting section movable-side conductor 11 is formed integrally, due to the weight of the disconnecting section movable-side conductor 11 and the movable conductor 12 the position of the center of gravity of these portions as a whole is slightly offset toward the disconnecting section 8 from the position of the center of gravity of the breaking section 1 alone, and is located where the breaking section movable-side conductor 4 is provided. For this reason, the vicinity of this position of the center of gravity can be insulated and supported, and the two supporting insulators 17 and 18 required in the conventional apparatus shown in FIG. 7 can be reduced to one supporting insulator 28 in FIG. 1.

The breaking section movable-side conductor 4 is supported by the first supporting insulator 28 and is electrically insulated from the supporting rack 16, so that the surface of the first supporting insulator 28 constitutes the creepage insulation portion. If salt or dust is attached to this surface, the insulating performance deteriorates. The creepage insulation portions should preferably be fewer in the light of such contamination. Since the apparatus shown in FIG. 1 has a fewer creepage insulation portions, insulation reliability is high.

In addition, as a result of the reduction in the number of supporting insulators, the number of parts can be reduced, and the production cost can be lowered.

In the above description, the first and second grounding conductors are provided at opposite ends of the apparatus, and the breaking section 1, the disconnecting section movable-side conductor 11, and the movable conductor 12 are supported by the single first supporting insulator 28. However, even in a case where the first and second grounding conductors 14 and 15 as well as the first and second grounding-section operating devices 25 and 26 are not provided in this apparatus, there is an advantage in that, by supporting the breaking section 1, the disconnecting section movable-side conductor 11, and the movable conductor 12 by the single supporting insulator, the number of the creepage insulation portions can be reduced, and the insulation reliability improves. In addition, even in a case where the breaking section 1, the disconnecting section movable-side conductor 11, and the movable conductor 12 by the single supporting insulator, are supported by two or more supporting insulators, if the disconnecting section fixed-side conductor 9 is disposed at the end portion side and is grounded by the second grounding conductor 15, and if the second grounding-section operating device 26 is disposed at the end portion side of the apparatus, there are advantages in that the size can be made small, and that the arrangement of the operating devices can be set in the same order as that of the electrical arrangement.

Second Embodiment

Figure 2:
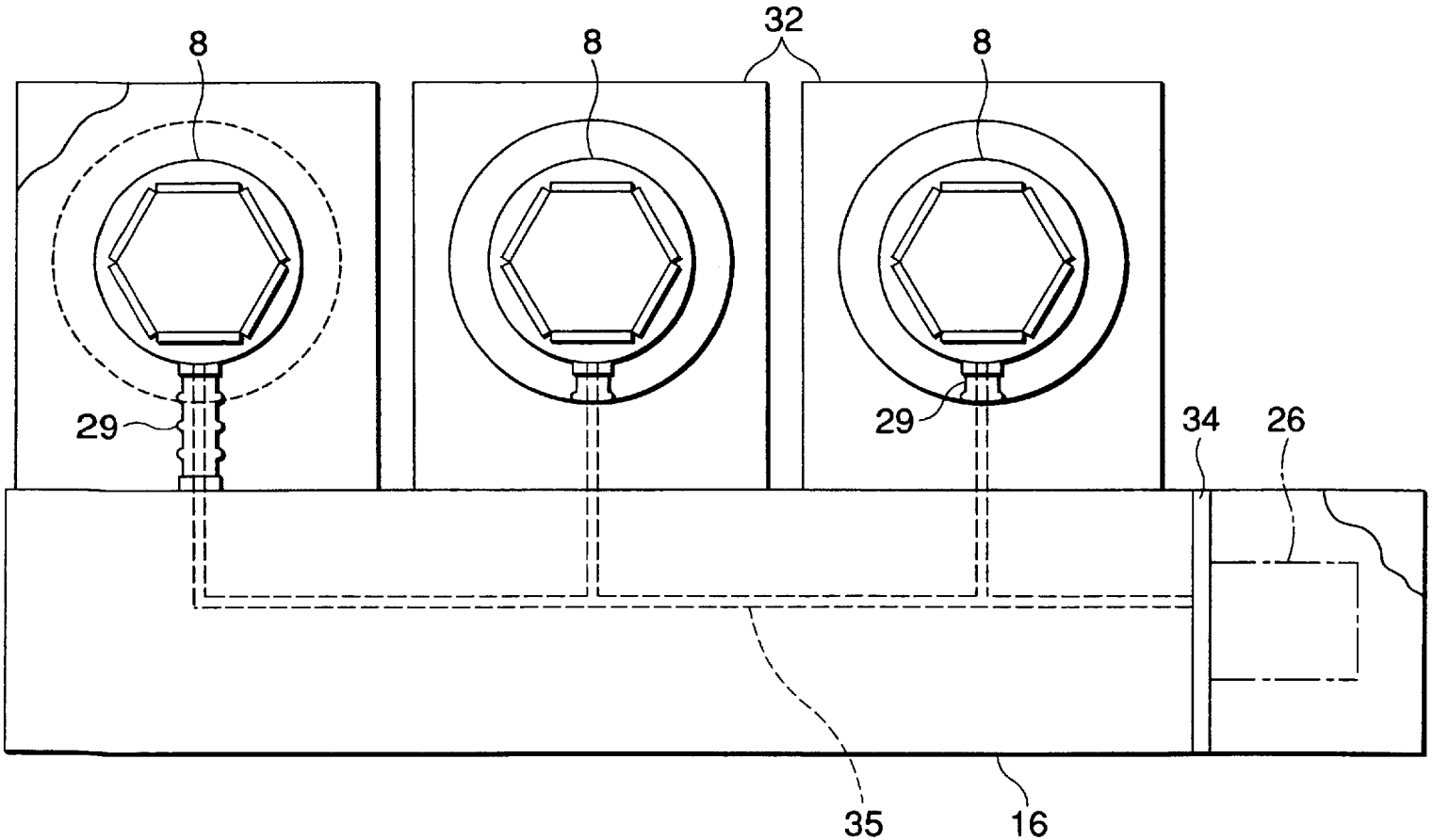
FIG. 2 is a side elevational view of a main circuit switching apparatus illustrating a second embodiment of the present invention.
Figure 3:
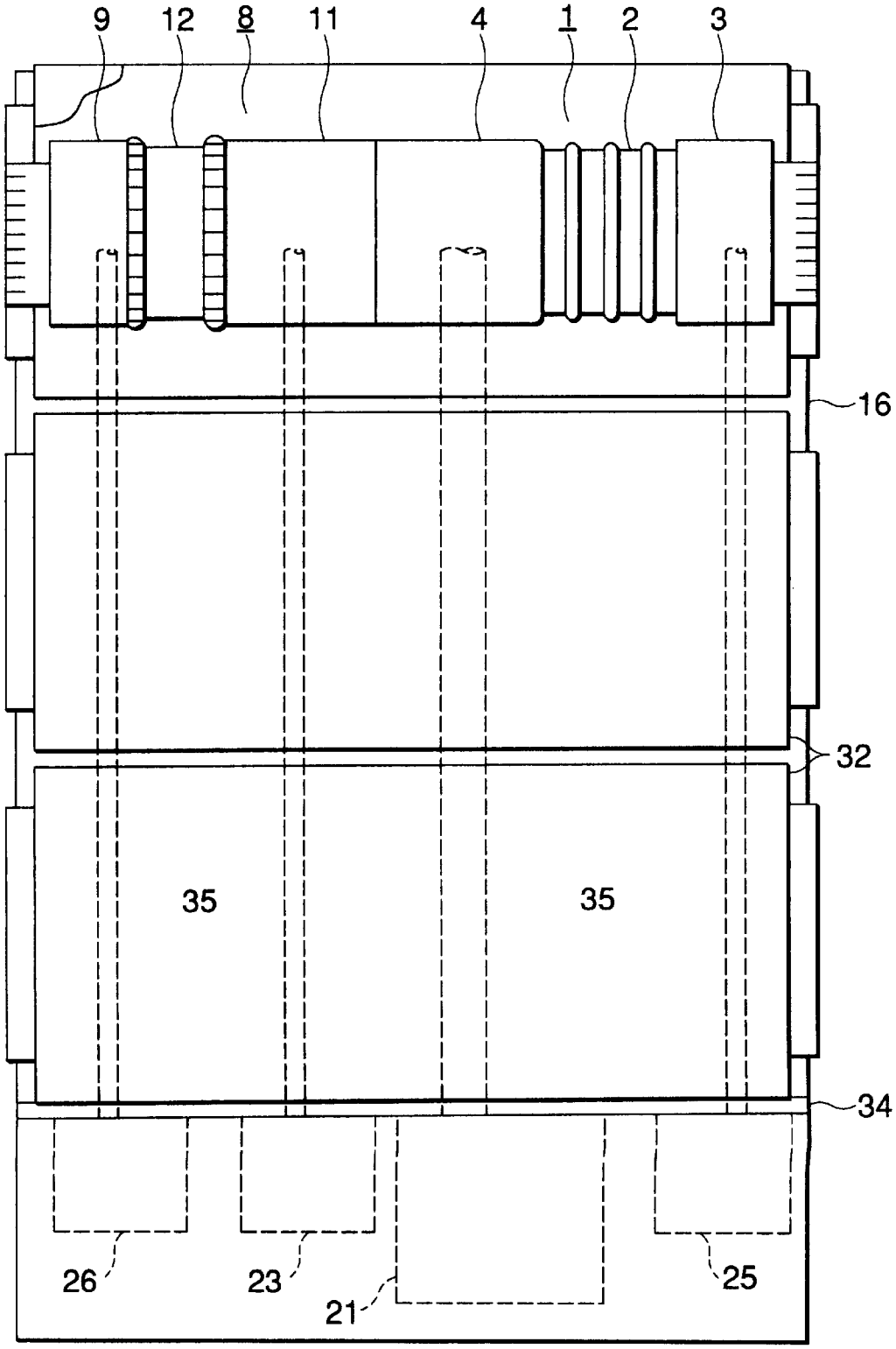
FIG. 3 is a plan view of a main circuit switching apparatus illustrating the second embodiment of the present invention.
Figure 5:
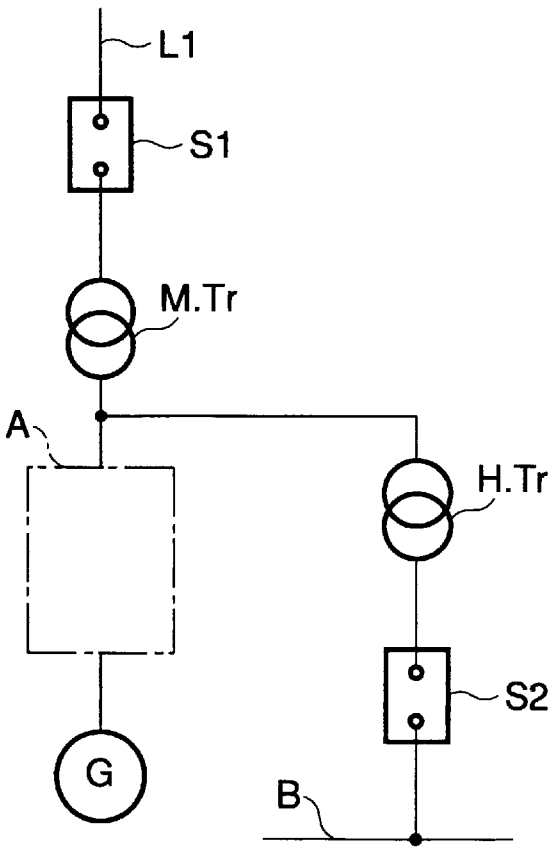
FIG. 5 is a single-line diagram of a power plant in the case of a low-tension synchronization system.
Figure 4:
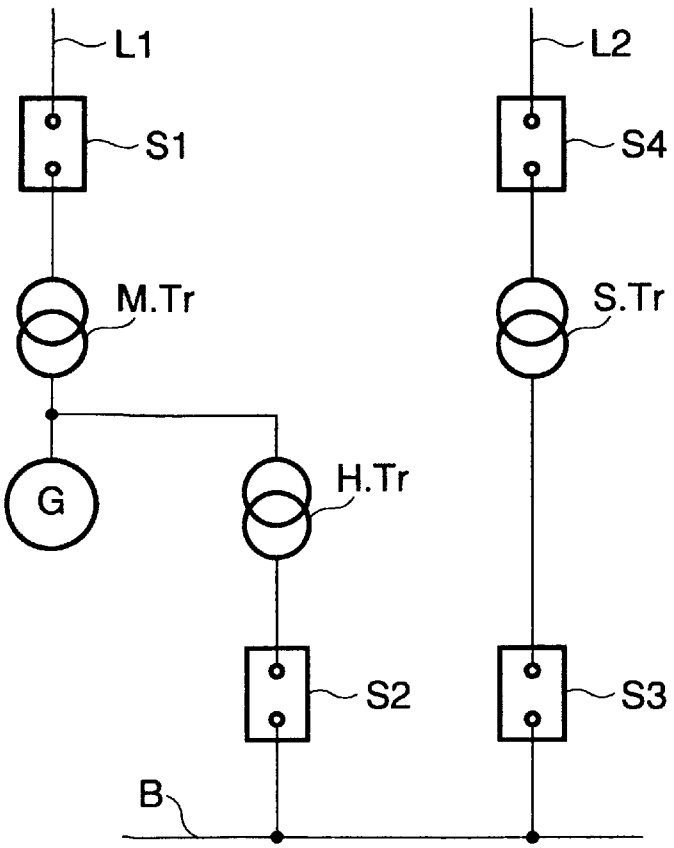
FIG. 4 is a single-line diagram of a power plant in the case of a high-tension synchronization system.

FIGS. 2 and 3 are a side elevational view and a plan view, respectively, of an main circuit switching apparatus, illustrating a second embodiment, and shows the case of an apparatus for three phases. A description of portions that are similar to those of the first embodiment will be omitted. The leftmost phase shown in FIG. 2 illustrates its interior with an outer covering removed. Also, the uppermost phase shown in FIG. 2 similarly illustrates its interior with the outer covering removed.

The breaking section 1, the disconnecting section 8, and the first and second grounding conductors 14 and 15 are respectively provided in three sets to serve the three phases, but the breaking-section operating device 21, the disconnecting-section operating device 23, and the first and second grounding-section operating devices 25 and 26 are used in common for the three phases, and single operating devices provided for each. These operating devices are fixed to one structural member with high stiffness, i.e., one thick plate 34 in this case, and are attached to the supporting rack 16 via the same. Numeral 35 denotes a connecting rod for transmitting the driving forces from the respective operating devices to the breaking sections 1 and the like. At a branching or bending point to each phase, the rotation is imparted by using a lever and a link which are not illustrated. The apparatus can be made compact and the cost can be lowered by making these operating devices common to the three phases.

The foregoing description of the preferred embodiments of the invention has been presented for the purpose of illustration and description only. It is not intended to be exhaustive or to limit the invention to the precise form disclosed, and modifications and variations are possible in light of and within the scope of the invention. The preferred embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and equivalents thereof.

[Advantages of the Invention]

The main circuit switching apparatus in accordance with the present invention is arranged such that the breaking section fixed-side conductor is disposed at the end portion side of the apparatus, the breaking section fixed-side conductor is grounded by the second grounding conductor, and the second grounding-section operating device for operating this second grounding conductor is disposed at the end portion of the apparatus. Accordingly, spaces below the disconnecting section fixed-side conductor and the disconnecting section movable-side conductor can be effectively used as spaces for mounting the disconnecting-section operating device and the second grounding-section operating device, respectively, so that the size of the apparatus can be made compact. In addition, the arrangement of the respective operating devices at this time is set in the same order as that of the electrical arrangement, so that it is possible to obtain an apparatus which reduces the possibility of erroneous confirmation and erroneous operation and which is easy to use.

The main circuit switching apparatus in accordance with the present invention is arranged such that the breaking section movable-side conductor and the disconnecting section movable-side conductor are integrated as a unit, and the breaking section, the disconnecting section movable-side conductor, and the movable conductor are supported by one supporting insulator. Accordingly, the number of creepage insulation portions can be reduced, and the insulation reliability improves. In addition, the number of parts can be reduced, and the production cost can be lowered.

In the main circuit switching apparatus in accordance with the present invention, the breaking section, the disconnecting section, and the first and second grounding conductors are respectively provided for three phases, and their operating devices are used in common for the three phases. Therefore, the apparatus can be made compact as an apparatus for three-phase use. Hence, the installation area is small, and single operating devices can be each used, so that the cost can be lowered.

In addition, the operating devices which are common to the three phases are attached to the supporting rack via a structural member. Therefore, the unified arrangement of the apparatus improves, and the ease of use improves.

What is claimed is:

1. A main circuit switching apparatus, comprising:

a breaking section having a breaking section fixed-side conductor provided with a fixed contact, and a breaking section movable-side conductor provided with a movable contact being contactable with said fixed contact;

a disconnecting section having a disconnecting section fixed-side conductor and a disconnecting section movable-side conductor which are disposed by being spaced apart from each other, said disconnecting section movable-side conductor having a movable conductor being contactable with said disconnecting section fixed-side conductor;

a plurality of supporting insulators, at least one of said plurality of supporting insulators supporting said breaking section and said disconnecting section on a supporting rack;

a breaking-section operating device for operating said movable contact;

a disconnecting-section operating device for operating said movable conductor;

a first grounding-section operating device operating a first grounding conductor for grounding said breaking section fixed-side conductor; and a second grounding-section operating device operating a second grounding conductor for grounding said disconnecting section fixed-side conductor, wherein said breaking section fixed-side conductor, said breaking section movable-side conductor, said disconnecting section movable-side conductor, and said disconnecting section fixed-side conductor are arranged in this order in a horizontal direction, and said breaking section movable-side conductor and said disconnecting section movable-side conductor are electrically and mechanically integrated as a unit, and further wherein said first grounding-section operating device, said breaking-section operating device, said disconnecting-section operating device, and said second grounding-section operating device are attached to said supporting rack in sequential order in the horizontal direction.

2. A main circuit switching apparatus according to claim 1, wherein said breaking section, said disconnecting section movable-side conductor, and said movable conductor are supported by one of said supporting insulators.

3. A main circuit swithcing apparatus according to claim 2, wherein said one of said supporting insulators is arranged in a vicinity of a position of a center of gravity of said breaking section, said disconnecting section movable-side conductor, and said movable conductor as a whole.

4. A main circuit switching apparatus according to claim 1, wherein said breaking section, said disconnecting section, and said first and second grounding conductors are respectively provided for a plurality of phases, and said breaking-section operating device, said disconnecting-section operating device, and said first and second grounding-section operating devices are made common for the plurality of phases.

5. A main circuit switching apparatus according to claim 4, wherein said breaking-section operating device, said disconnecting-section operating device, and said first and second grounding-section operating devices are attached to said supporting rack via a structural member being high stiffness.

6. A main circuit switching apparatus, comprising:

a breaking section having a breaking section fixed-side conductor provided with a fixed contact, and a breaking section movable-side conductor provided with a movable contact being operated by a breaking-section operating device so that said movable contact is contactable with said fixed contact;

a disconnecting section having a disconnecting section fixed-side conductor and a disconnecting section movable-side conductor which are spaced apart from each other, said disconnecting section movable-side conductor having a movable conductor being operated by a disconnecting section operating device so that said movable conductor is contactable with said disconnecting section fixed-side conductor; and a supporting insulator supporting said breaking section, said disconnecting section movable-side conductor, and said movable conductor, wherein said breaking section fixed-side conductor, said breaking section movable-side conductor, said disconnecting section movable-side conductor, and said disconnecting section fixed-side conductor are arranged in sequential order in a horizontal direction, and said breaking section movable-side conductor and said disconnecting section movable-side conductor are electrically and mechanically integrated as a unit.

7. A main circuit swithcing apparatus according to claim 6, wherein said said supporting insulator is arranged in a vicinity of a position of a center of gravity of said breaking section, said disconnecting section movable-side conductor, and said movable conductor as a whole.

* * * * *